US006985057B2

(12) United States Patent
Lesutis

(10) Patent No.: US 6,985,057 B2
(45) Date of Patent: Jan. 10, 2006

(54) QUICK TURN-LOCK WAVEGUIDE TRANSITION ASSEMBLY

(75) Inventor: John Lesutis, Livingston (GB)

(73) Assignee: Andrew Corporation, Orland Park, IL (US)

( * ) Notice: Subject to any disclaimer, the term of this patent is extended or adjusted under 35 U.S.C. 154(b) by 22 days.

(21) Appl. No.: 10/605,247

(22) Filed: Sep. 17, 2003

(65) Prior Publication Data

US 2005/0057328 A1 Mar. 17, 2005

(51) Int. Cl.
*H01P 1/06* (2006.01)

(52) U.S. Cl. ..... 333/255; 333/256; 285/33; 285/406

(58) Field of Classification Search ..... 333/255, 333/254, 256, 257; 285/33, 406; 343/882
See application file for complete search history.

(56) References Cited

U.S. PATENT DOCUMENTS 2,862,728 A * 12/1958 Druschel et al. ..... 285/24
3,202,946 A * 8/1965 Newman ..... 333/255
3,681,714 A 8/1972 Terakawa ..... 333/21 R
6,297,710 B1 10/2001 Cook et al. ..... 333/21 A
6,433,757 B1 8/2002 Shrader ..... 343/915

* cited by examiner

*Primary Examiner*—Stephen E. Jones

(74) *Attorney, Agent, or Firm*—Babcock IP, LLC

(57) ABSTRACT

A turn-lock waveguide transition assembly mountable to, for example, the feed assembly of an antenna. The transition assembly having a clamping groove which engages, for example, the heads of a plurality of clamping screws upon seating of the transition assembly onto a spigot of the feed assembly. The clamping screw heads enter the clamping groove via cut-outs along the sides of the transition assembly and engage the clamping groove upon rotation of the transition assembly. Alignment indicia on the transition assembly and the, for example, antenna base aid quick alignment of the transition assembly to a desired alignment, for example to a selected polarization if an aperture is added to a bore of the transition assembly. Because of the engagement between the clamping groove and the clamping screw heads, the polarization may be changed 90 degrees without removing the transition assembly from the spigot.

18 Claims, 5 Drawing Sheets

QUICK TURN-LOCK WAVEGUIDE TRANSITION ASSEMBLY

BACKGROUND OF INVENTION

1. Field of the Invention

This invention relates to the precision and variable angle attachment between two waveguide components, for example the transition between a feed waveguide or transmitter output and a dual reflector antenna feed assembly. More particularly, the invention relates to a cost effective feed transition assembly with quick tool-less initial mounting and widely variable connection angle alignment features.

2. Description of Related Art

Microwave antennas commonly have a feed assembly linked to a transmitter or receiver by a waveguide. To minimize signal degradation, the waveguide components are precision formed to create closely aligned and gap free interconnections. An aperture in the waveguide signal path may be aligned to select between vertical and horizontal polarization by alternating the aperture orientation by 90 degrees. In addition to primary orientation for a desired polarization, a fine tuning ability is desirable to enable optimizing the selected polarization.

Prior dual reflector microwave antennas have used an aperture slip ring with a plurality of bolt holes, each bolt hole in the form of an arc shaped slot to permit fine adjustment of the selected aperture angle. This configuration has three main disadvantages. First, at least one of the plurality of bolts required to attach the aperture need to be inserted and threaded before the aperture becomes self-supporting. Seemingly simple mechanical operations of this type are made much more difficult when they must be performed in exposed locations such as high atop a radio tower. Second, the assembly is relatively expensive to manufacture, because the plurality of arc shaped bolt slots require complex machining capabilities. Also, the overall number of required separate components is significant, increasing a drop hazard during installation and maintenance. Third, to maintain the strength of the component, the arc shaped bolt holes have a minimal angular adjustment range. To change the angle 90 degrees from vertical to horizontal polarization, or vice versa, the entire assembly must be removed, rotated and again supported while the initial bolt(s) are re-inserted and tightened.

Alternatively, a slip ring separate from the aperture has been used, adding additional costs and introducing additional potential failure points to the overall system while maintaining the drawbacks described hereinabove.

Competition within the communications component and or systems industry has focused attention on structural integrity, materials and manufacturing operations costs. Also, ease of installation and service is a growing component and or system selection consideration.

Therefore, it is an object of the invention to provide an apparatus that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
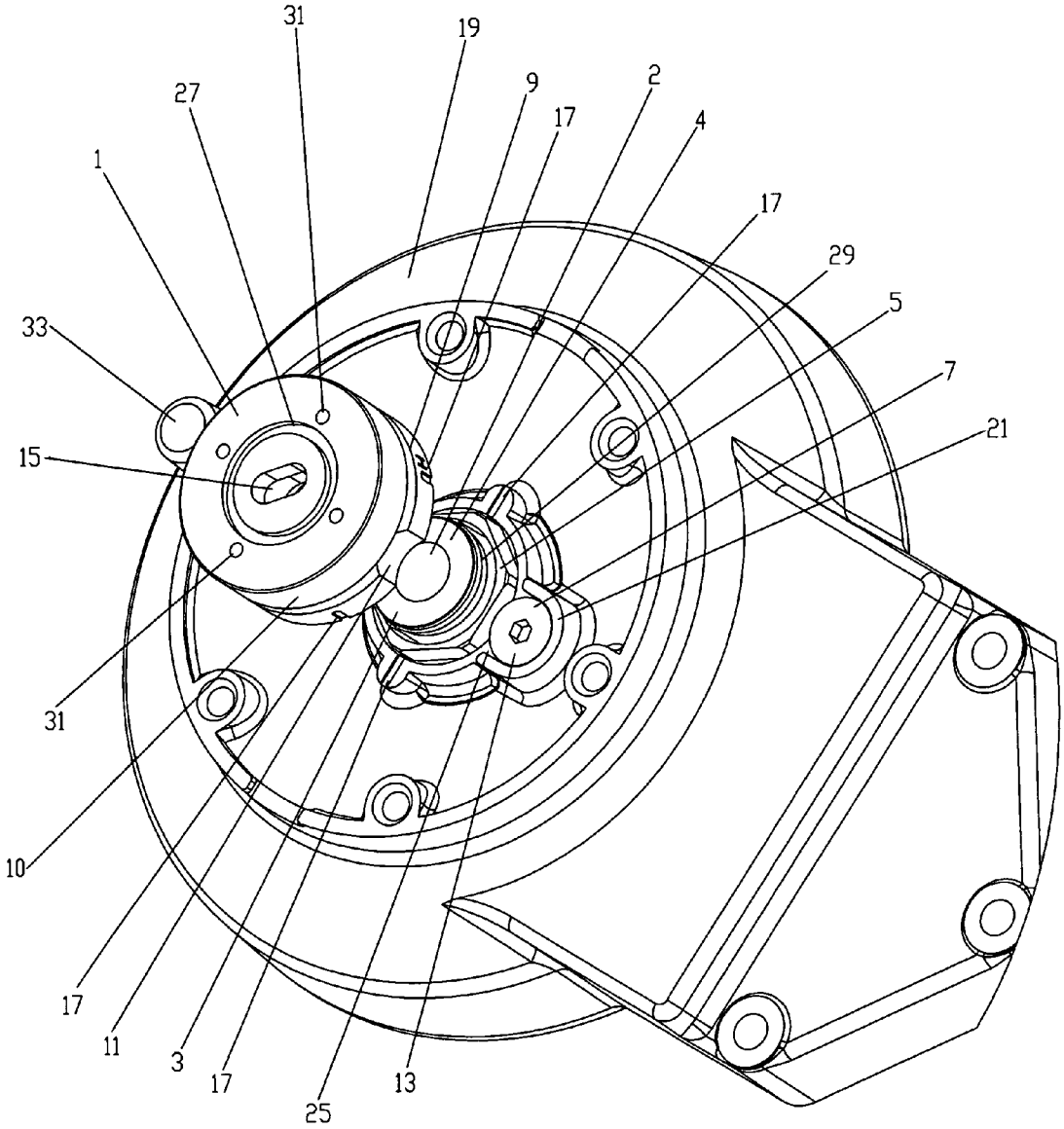
FIG. 1 is an exploded isometric angled top side view of a first embodiment of the invention.
Figure 2:
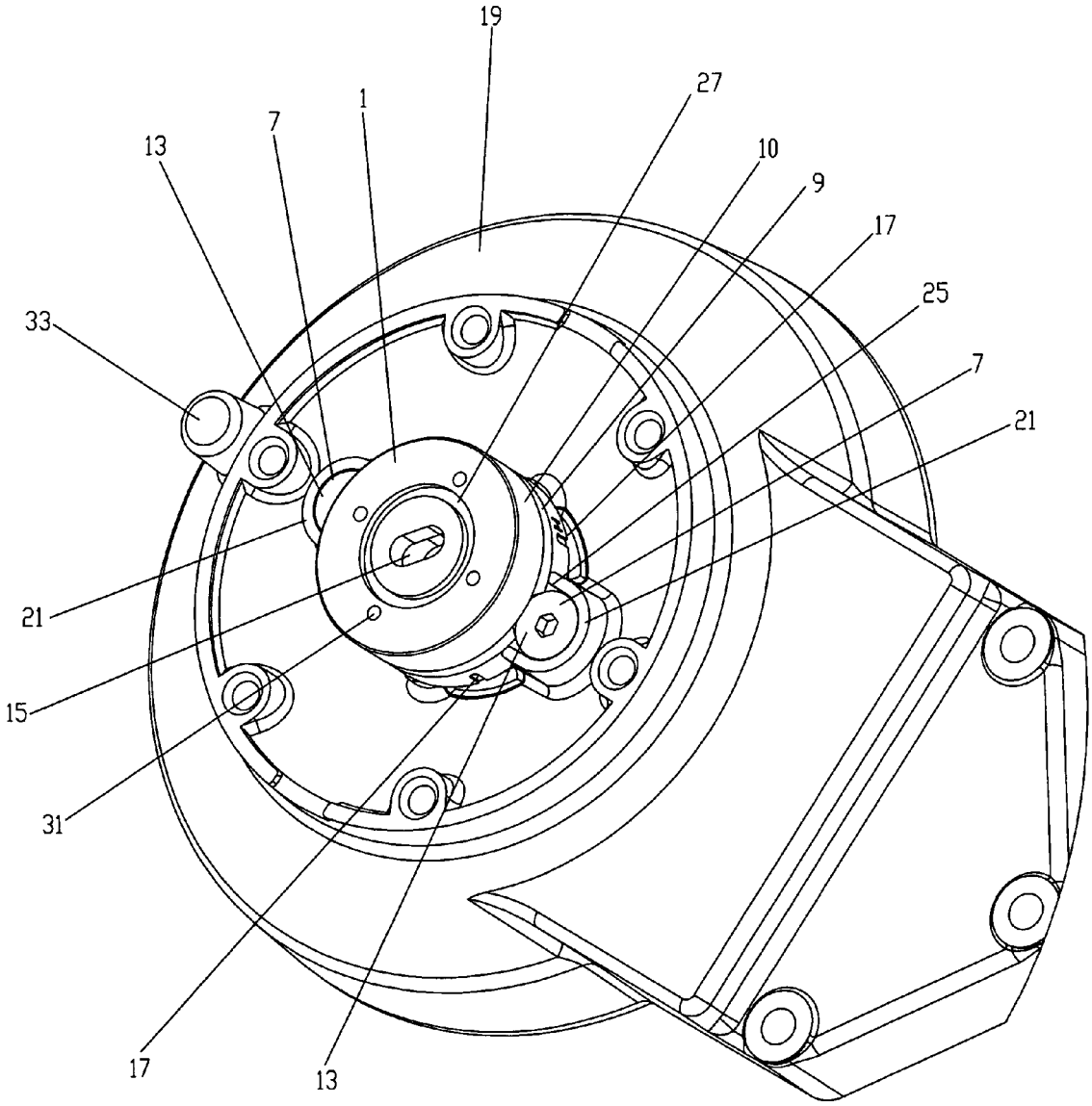
FIG. 2 is an isometric angled top side view of FIG. 1, with the transition assembly seated against the feed assembly spigot.
Figure 3:
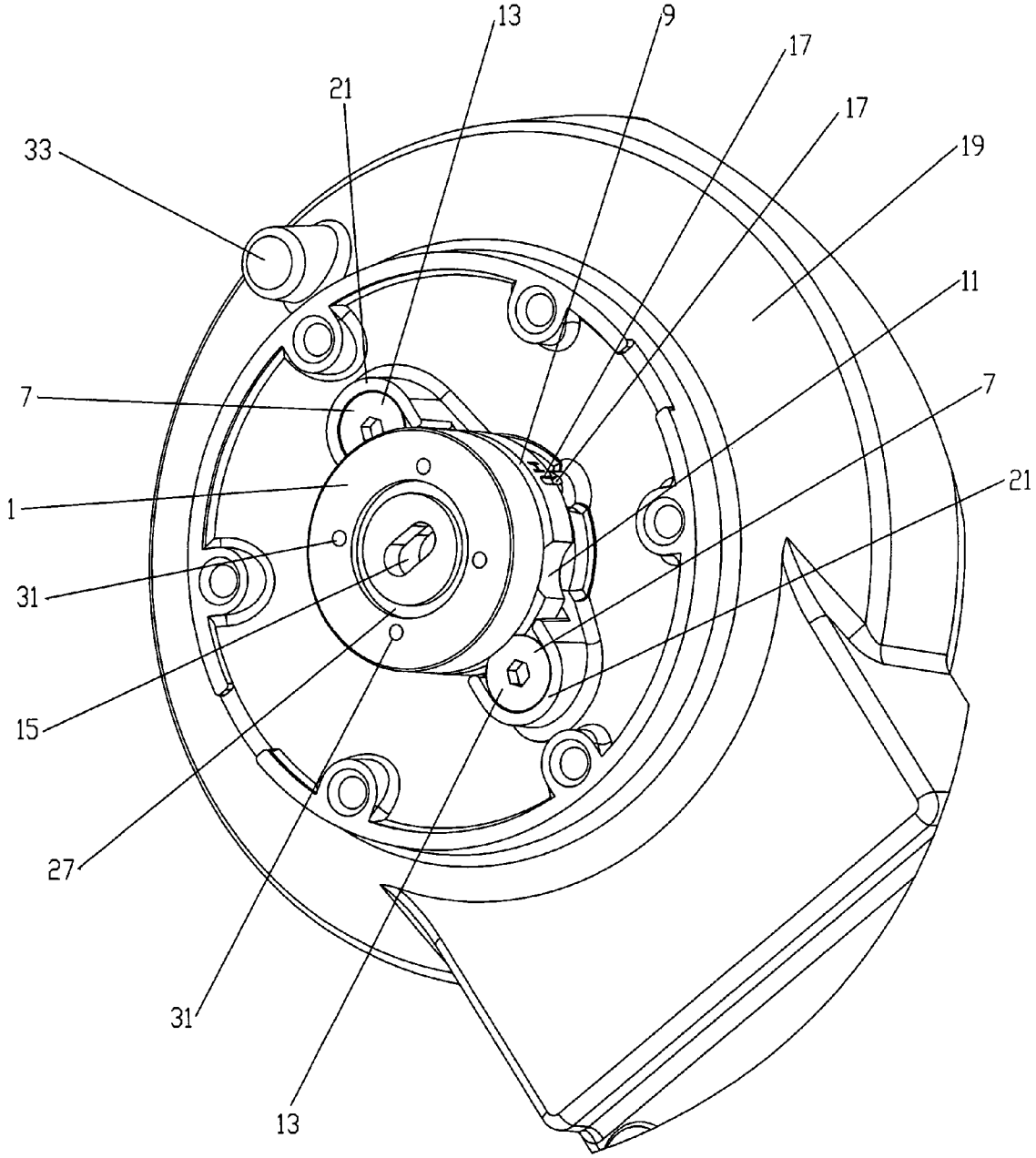
FIG. 3 is an isometric angled top side view of FIG. 1, with the transition assembly seated against the feed assembly spigot and rotated to align the transition assembly with a first polarization groove.
Figure 4:
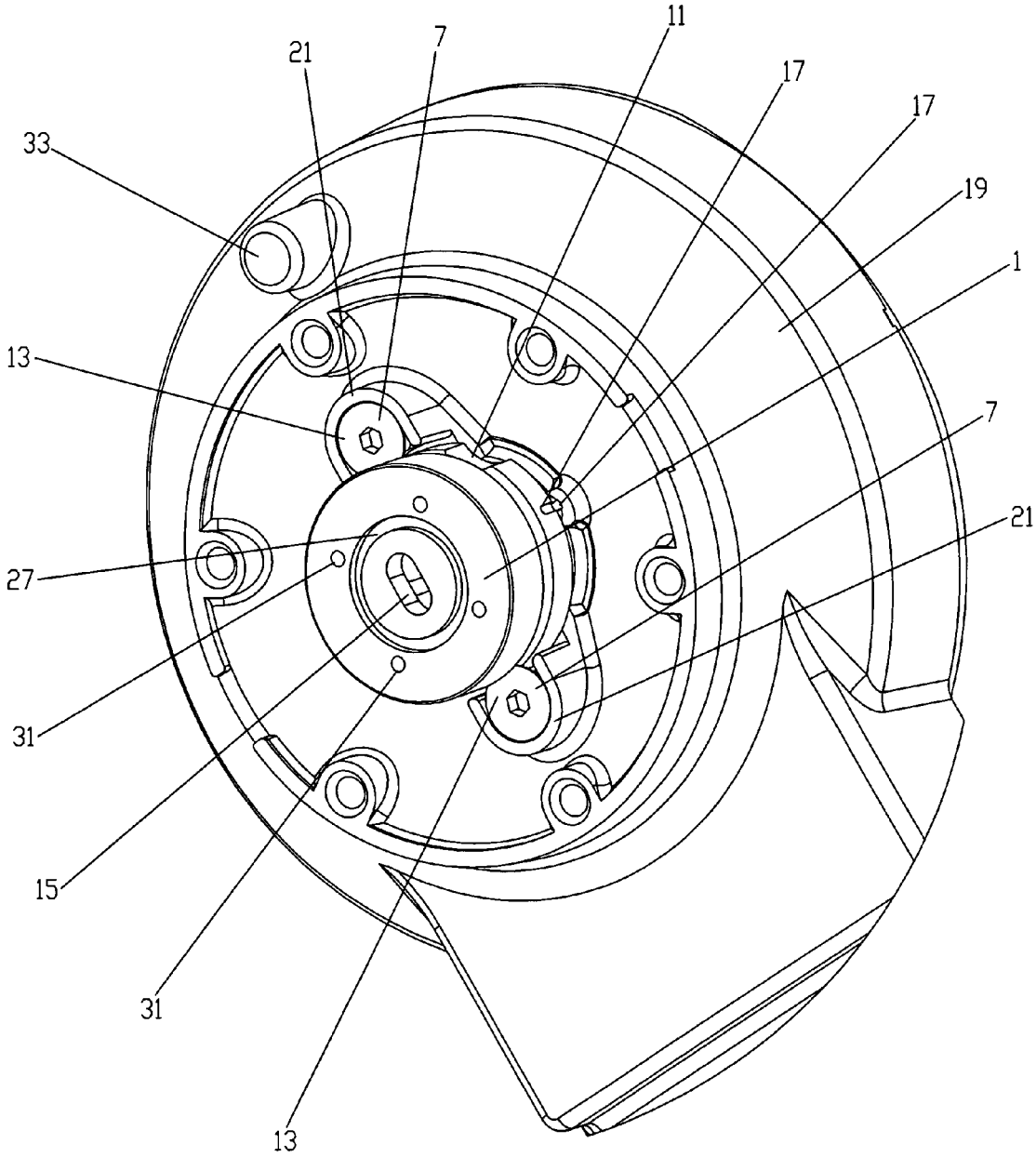
FIG. 4 is an isometric angled top side view of FIG. 1, with the transition assembly seated against the feed assembly spigot and rotated to align the transition assembly with a second polarization groove.
Figure 5:
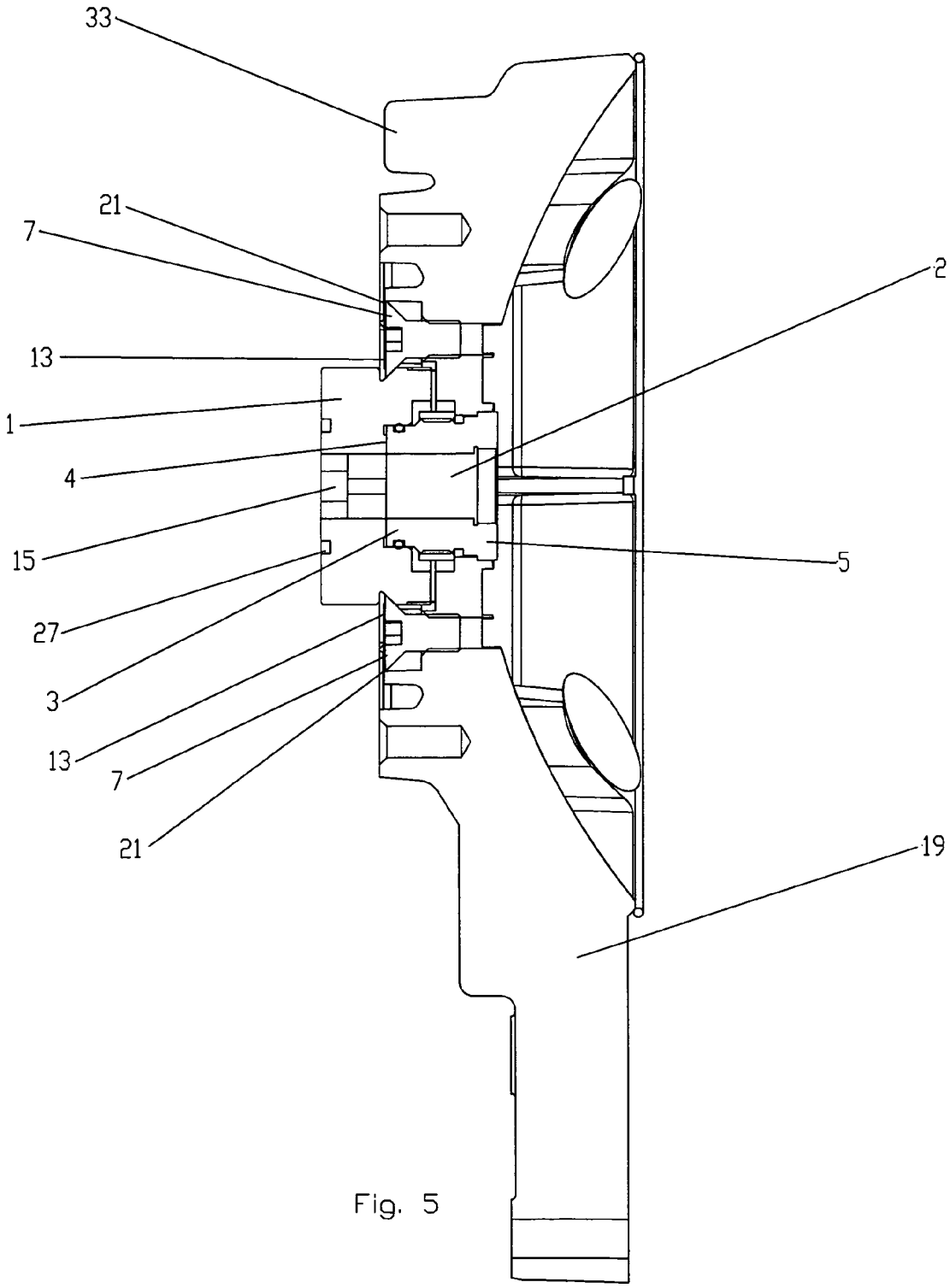
FIG. 5 is a cross sectional schematic side view of the first embodiment of the invention, applied to an antenna base casting with a self supported feed assembly hub.

A first embodiment of the invention is described with reference to FIGS. 1–5. A transition assembly 1 with a waveguide 2 there through is adapted to mate with the feed point, also known as the spigot 3, of an antenna feed assembly 5. The transition assembly 1 is retained against the spigot 3 at a spigot end 4 by a pair of clamping screw(s) 7 that engage a clamping groove 9 formed in an outer surface 10 of the transition assembly 1. Cutout(s) 11 formed in the outer surface 10 of the transition assembly 1 extending from the spigot end 4 of the assembly to the clamping groove 9 allow the clamping screw(s) 7 to reach the clamping groove 9 without interference from the transition assembly 1 during an initial seating of the transition assembly 1 against the spigot 3. Then, rotation of the transition assembly 1 engages an outer edge of each clamping screw head 13 into the clamping groove 9, retaining the transition assembly 1 against the spigot 3.

An aperture 15 may be formed in the transition assembly 1 to configure the polarization of the antenna feed assembly 5. Alignment indicia 17, for example grooves, formed on both the transition assembly 1 and a mating surface of the, for example, antenna base 19 corresponding to a desired angular orientation of the transition assembly 1 with respect to the base 19 provide a quick reference for aligning the aperture 15 via rotation of the transition assembly 1. The aperture 15 may be machined directly into the transition assembly 1 or configured as a separate component which inserts into and is retained by the transition assembly 1, allowing the user to select from a range of different apertures 15, depending upon the specific application at hand.

The clamping screw(s) 7 may be provided with a guide surface 21 formed in an area of the base 19 surrounding a portion of each clamping screw head 13. The guide surface(s) 21 are adapted to a level from the base 19 which corresponds to the clamping groove 9 whereby when the top of each of the clamping screw(s) 7 is flush with the top of the respective guide surface(s) 21 the clamping screw(s) 7 are aligned to engage the clamping groove 9 upon initial seating of the transition assembly 1 onto the spigot 3. To ensure that the clamping screw(s) 7 securely retain the transition assembly 1 over time, an anti-vibration coating 25 may be added to the clamping screw 7 threads and or contact surfaces of the clamping screw head(s) 13. Alternatively and or additionally, the anti-vibration coating 25 may be added to the clamping groove 9.

Sealing groove(s) 27 may be added to the spigot 3 and or transition assembly 1 to provide a seat for O-rings 29 or other gaskets used to seal the interconnection between the transition assembly 1 and the spigot 3 and or the transition assembly 1 and further waveguide components or a transmitter/receiver (not shown) connected to the transition assembly 1 via, for example, screws mating with screw holes 31.

In use, the clamping screw(s) 7 are screwed into the base 23 to a level where the clamping screw head(s) 13 are flush with the guide surface(s) 21. The transition assembly 1 cutout(s) 11 are aligned with the clamping screw(s) 7 and the transition assembly 1 seated onto the spigot 3. The transition assembly 1 may then be rotated to engage the clamping screw head(s) 13 into the clamping groove 9. The transition assembly 1 is rotated until the alignment indicia 17 of a desired polarization are aligned. Precision adjustment of the polarization alignment may then be made with the initial alignment as the starting point. When aligned as desired, the clamping screw(s) 7 are tightened to secure the transition assembly 1 to the spigot 3.

When a change of polarization, for example from vertical to horizontal is desired, only the clamping screw(s) 7 need be partially loosened and the transition assembly 1 rotated and aligned as desired proximate the opposite alignment indicia 17. The waveguide and or other components attached to the transition assembly 1 need not be removed, because unless the transition assembly is fully rotated to an alignment where the cutout(s) 11 are aligned with the clamping screw(s) 7, the transition assembly 1 is retained upon the spigot 3 by the clamping screw head(s) 13 engagement with the clamping groove 9.

If automated polarization control and or fine tuning is desired, the transition assembly 1 may be configured to be rotatable by having the clamping screws tightened to secure the clamp screw heads in the clamp groove but not to prevent rotation of the transition assembly 1 which may then be rotatably driven by a drive (not shown) anchored, for example by a boss 33 formed in the base 19.

Alternatively, rather than using the clamping screw head(s) 13, the clamping screw(s) 7 may use tabs, washers, keyed retaining rings or the like as means for engaging the clamping groove 9.

One skilled in the art will appreciate that the present invention may be cost effectively fabricated without requiring advanced machining operations. Manufacturing and installation efficiencies are also increased when one appreciates that minimizing the number of necessary interconnecting screws and or bolts reduces the total number of components.

The present invention brings to the art a cost efficient quick turn-lock transition assembly 1 that may be aligned for either vertical or horizontal polarization without removing it from, for example, the feed assembly 5 of an antenna. Further, the present invention provides heretofore unavailable ease of installation and or service characteristics, including the ability to align the transition assembly 1 for either vertical or horizontal polarization without removing it from, for example, the feed assembly 5 of an antenna.

Table of Parts

| | |
|---|---|
| 1 | transition assembly |
| 2 | waveguide |
| 3 | spigot |
| 4 | spigot end |
| 5 | antenna feed assembly |
| 7 | clamping screw |
| 9 | clamping groove |

-continued

Table of Parts

| | |
|---|---|
| 10 | outer surface |
| 11 | cutout |
| 13 | clamping screw head |
| 15 | aperture |
| 17 | alignment indicia |
| 19 | base |
| 21 | guide surface |
| 25 | anti-vibration coating |
| 27 | sealing groove |
| 29 | o-ring |
| 31 | screw hole |
| 33 | boss |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A waveguide transition assembly for an antenna having a feed assembly with a spigot, comprising:

a transition assembly having a waveguide formed there through, adapted to mate with the spigot;

the transition assembly having a clamping groove formed in an outer surface and a plurality of cut-outs in the outer surface extending axially from a spigot end to the clamping groove, a plurality of clamp screws coupled to a base of the antenna located to allow passage along the plurality of cutouts to the clamping groove as the transition assembly is seated upon the spigot and rotated;

the clamp screws having clamp screw heads which upon entry into the clamping groove retain the transition assembly upon the spigot.

2. The assembly of claim 1, further including a guide surface formed proximate each of the plurality of clamp screws;

the guide surfaces adapted to indicate a height at which the clamp screw heads will engage the clamp groove when the transition assembly is seated upon the spigot.

3. The assembly of claim 1, further including an anti-vibration coating upon one of the plurality of clamping screws and the clamping groove.

4. The assembly of claim 1, further including a groove on the feed assembly proximate the spigot and one of a gasket and an o-ring located in the groove.

5. The assembly of claim 1, further including an aperture in the waveguide.

6. The assembly of claim 5, wherein the aperture is removable from the transition assembly.

7. The assembly of claim 5, further including alignment indicia on the transition assembly and base whereby the aperture may be aligned at a desired orientation.

8. The assembly of claim 7, wherein the alignment indicia are grooves.

9. A waveguide transition assembly for an antenna having a feed assembly with a spigot, comprising:

a transition assembly having a waveguide with an aperture formed there through, adapted to mate with the spigot;

the transition assembly having a clamping groove formed in an outer surface of the transition assembly and a plurality of cut-outs in the outer surface extending axially from a spigot end to the clamping groove, a plurality of clamp screws coupled to a base of the antenna located to allow passage through the plurality of cut-outs;

the clamp screws having clamp screw heads which upon entry into the clamping groove retain the transition assembly upon the spigot;

a plurality of corresponding alignment indicia on the transition assembly and base whereby the aperture may be aligned at a desired orientation; and a guide surface formed proximate each of the plurality of clamp screws;

the guide surface adapted to indicate a height at which the clamp screw heads will engage the clamp groove when the transition assembly is seated upon the spigot and rotated.

10. The assembly of claim 9, wherein the alignment indicia are grooves.

11. The assembly of claim 9, further including an anti-vibration coating upon one of the plurality of clamping screws and the clamping groove.

12. The assembly of claim 9, further including a groove on the feed assembly proximate the spigot and one of a gasket and an o-ring located in the groove.

13. The assembly of claim 9, wherein the aperture is removable from the transition assembly.

14. A waveguide transition assembly for an antenna having a feed assembly with a spigot, comprising:

a transition assembly having a waveguide formed there through, adapted to mate with the spigot;

the transition assembly having a clamping groove formed in an outer surface and at least one cut-out in the outer surface extending axially from a spigot end to the clamping groove, at least one clamp screw and at least one means for engaging coupled to a base of the antenna is located to allow passage along the at least one cut-out to the clamping groove as the transition assembly is seated upon the spigot and then rotated;

the means for engaging, upon entry into the clamping groove, retains the transition assembly upon the spigot;

the means for engaging secured by the clamp screws.

15. The assembly of claim 14, wherein the means for engaging is one of a clamp screw head, a washer, a tab and a keyed retaining ring.

16. The assembly of claim 14, wherein the alignment indicia are grooves.

17. The assembly of claim 14, further including an anti-vibration coating upon one of the plurality of clamping screws and the clamping groove.

18. The assembly of claim 14, wherein the aperture is removable from the transition assembly.

* * * * *